United States Patent [19]

Mathur

[11] Patent Number: 4,995,455

[45] Date of Patent: Feb. 26, 1991

[54] PLATE HEAT EXCHANGER WITH GLUELESS GASKETS

[75] Inventor: Achint P. Mathur, Wichita Falls, Tex.

[73] Assignee: Tranter, Inc., Augusta, Ga.

[21] Appl. No.: 489,227

[22] Filed: Mar. 6, 1990

Related U.S. Application Data

[63] Continuation-in-part of Ser. No. 375,190, Jul. 3, 1989, Pat. No. 4,905,758.

[51] Int. Cl.[5] ..... F28F 3/10

[52] U.S. Cl. ..... 165/166; 165/167

[58] Field of Search ..... 165/166, 167

[56] References Cited

U.S. PATENT DOCUMENTS

| | | | |
|---|---|---|---|
| 3,244,227 | 4/1966 | Usher | 165/167 |
| 4,377,204 | 3/1983 | Johansson | 165/166 |
| 4,635,715 | 1/1987 | Andersson | 165/167 |

FOREIGN PATENT DOCUMENTS

| | | | |
|---|---|---|---|
| 2618889 | 2/1989 | France | 165/166 |
| 33392 | 7/1974 | Japan . | |
| 52-130048 | 11/1977 | Japan . | |
| 1-101082 | 7/1989 | Japan . | |
| 766932 | 1/1957 | United Kingdom | 165/166 |
| 2028996B | 3/1980 | United Kingdom . | |
| 2069680A | 8/1981 | United Kingdom | 165/166 |
| 2078926A | 1/1982 | United Kingdom | 165/166 |
| 2117890A | 10/1983 | United Kingdom . | |
| 2075656B | 12/1983 | United Kingdom . | |
| 2145511A | 3/1985 | United Kingdom | 165/167 |
| 2138931B | 7/1986 | United Kingdom . | |
| 2189590A | 2/1987 | United Kingdom . | |

*Primary Examiner*—Alan Cohan
*Assistant Examiner*—Allen J. Flanigan
*Attorney, Agent, or Firm*—Barnes, Kisselle, Raisch, Choate, Whittemore & Hulbert

[57] ABSTRACT

A heat exchanger plate has an elongated peripheral groove spaced inwardly from the edge of the plate. Openings are provided in the outer side wall of the groove. A gasket has an elongated main body portion seated in the groove with integral tabs projecting through the openings. The tabs may be long enough to be grasped from the underside of the plate and pulled through the openings to fully seat the main body portion of the gasket in the groove. The tabs may also have shoulders engaged with an edge of the openings to retain the tabs in the installed position. Tabs are also disclosed which have a button on the outer end which will snap into the opening under downward pressure. As an alternative to gasket tabs, recesses may be formed in the main body portion of the gasket to fit under tabs on the outer side wall of the plate groove.

20 Claims, 4 Drawing Sheets

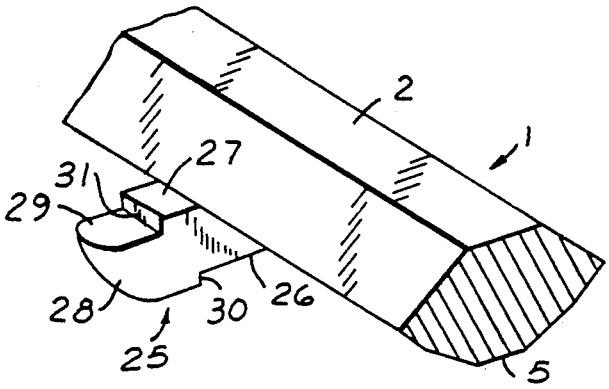
FIG.8
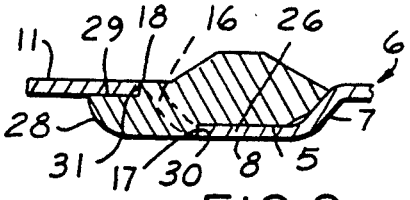
FIG.9
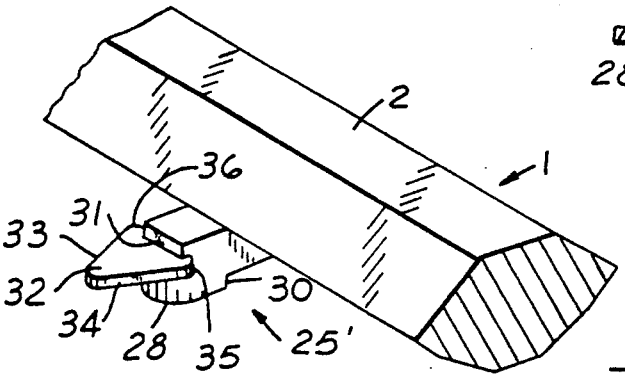
FIG.10
FIG.11
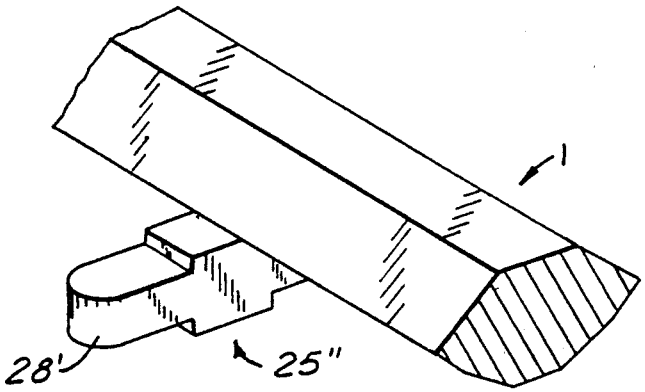
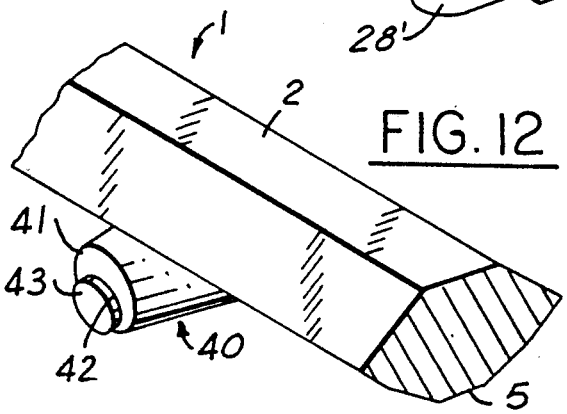
FIG.12
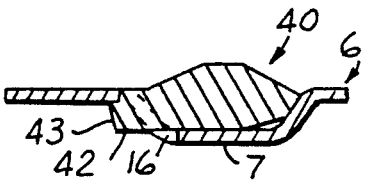
FIG.13

PLATE HEAT EXCHANGER WITH GLUELESS GASKETS

REFERENCE TO RELATED APPLICATION

This application is a continuation-in-part of application Ser. No. 07/375,190 filed July 3, 1989, now U.S. Pat. No. 4,905,758.

This invention relates to plate heat exchangers and refers more particularly to a plate heat exchanger having heat exchanger plates provided with peripheral gasket grooves in which sealing gaskets are located.

BACKGROUND AND SUMMARY OF THE INVENTION

A plate and frame heat exchanger consists of several corrugated heat transfer plates which are clamped together between a stationary frame and a movable frame. The plates with their gaskets hang vertically from a horizontal guide bar. To ensure that the gaskets will not fall off the vertical plates during assembly and disassembly, the gaskets must be held in place prior to hanging of the plates on the guide bar.

Heat exchanger plates are generally of two types. In one type, the gaskets are held in the gasket groove by means of a continuous line of glue. In the other type, the gaskets are held in the groove by a glueless connection. One example of a glueless connection is shown in U.S. Pat. No. 4,377,204.

The present invention relates to several designs of a glueless type connection in which the gasket has integral tabs which engage on the outer side wall of the gasket groove in the plate.

In accordance with the construction described hereinafter, the heat exchanger plate has an elongated gasket groove spaced inwardly from an edge of the plate. Openings are provided in the outer side wall of the gasket groove. A gasket of flexible, compressible material has an elongated main body portion seated in the groove. Tabs integral with the main body portion project into the openings to provide a glueless connection. A tab may be inserted in an opening by either pushing the tab through the opening or pressing it downwardly into the opening.

The openings may be formed by using a pierce die on a flat metal sheet, prior to forming the sheet into a plate.

Objects of this invention include the provision of a glueless type connection which has the foregoing features, which is inexpensive to manufacture, and which will permit the intermixing of the plates of this invention with existing plates having glued gaskets. Another object is to provide a method of forming openings in the outer side wall of the gasket groove in a plate.

BRIEF DESCRIPTION OF THE DRAWINGS

FIG. 8 is a view similar to FIG. 1, but shows a modification of the gasket tab.

FIG. 9 is a sectional view similar to FIG. 7, showing the tab of FIG. 8 fully inserted in an opening in the plate of FIG. 2.

FIG. 10 is a view similar to FIG. 1, but shows another modification of the gasket tab.

FIG. 11 is a view similar to FIG. 1, but shows still another modification of the gasket tab.

FIG. 12 is a view similar to FIG. 1, but shows a further modification of a tab which is of a snap-in (push-down) design.

FIG. 13 is a sectional view similar to FIG. 7, showing the tab of FIG. 12 in the opening of the plate.

DETAILED DESCRIPTION

Figure 1:
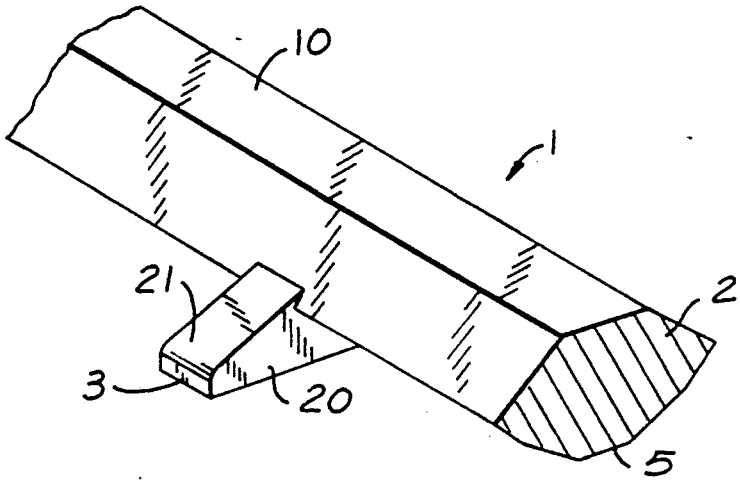
FIG. 1 is an isometric view with parts broken away of a portion of a gasket constructed in accordance with this invention, showing one of a plurality of integral tabs on the gasket located in spaced apart relation along the length thereof.
Figure 2:
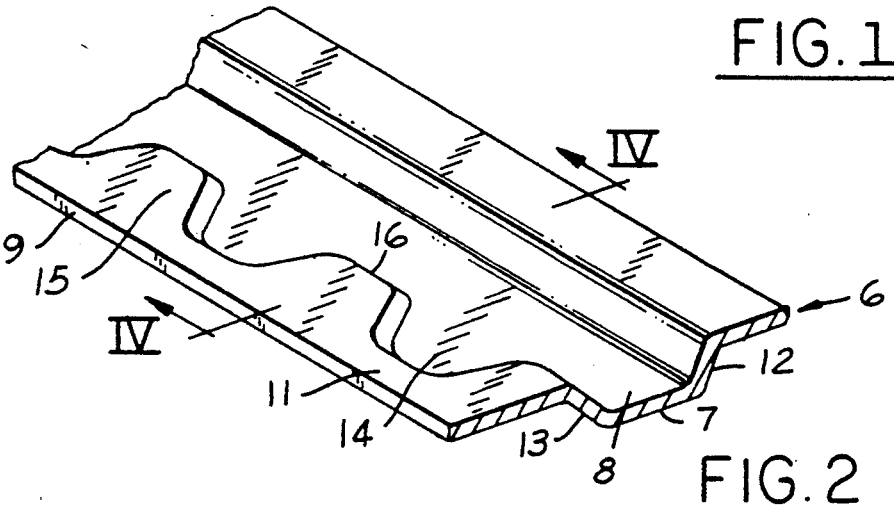
FIG. 2 is an isometric view of a portion of a heat exchanger plate also constructed in accordance with this invention, as seen from one side of the plate.
Figure 4:
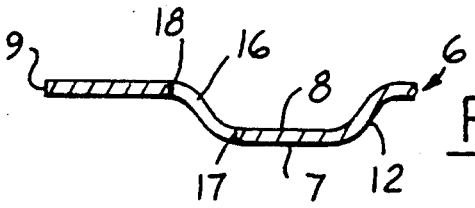
FIG. 4 is a sectional view taken on the line IV—IV in FIG. 2 which shows the opening in the outer side wall of the gasket groove in the plate.
Figure 3:
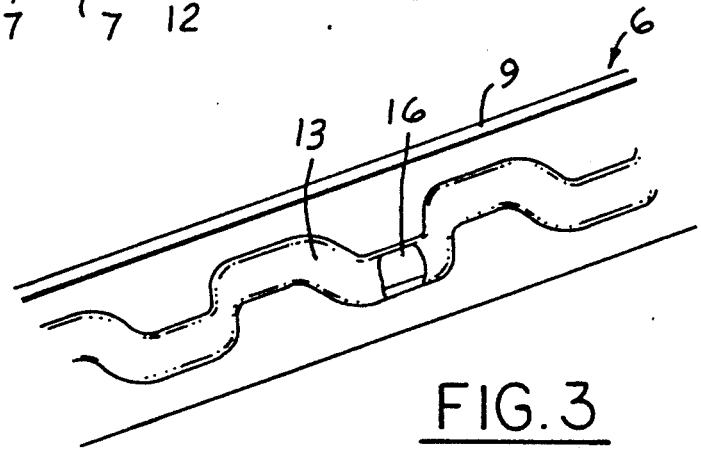
FIG. 3 is an isometric view of a portion of the heat exchanger plate shown in FIG. 2, as seen from the opposite side thereof.
Figure 5:
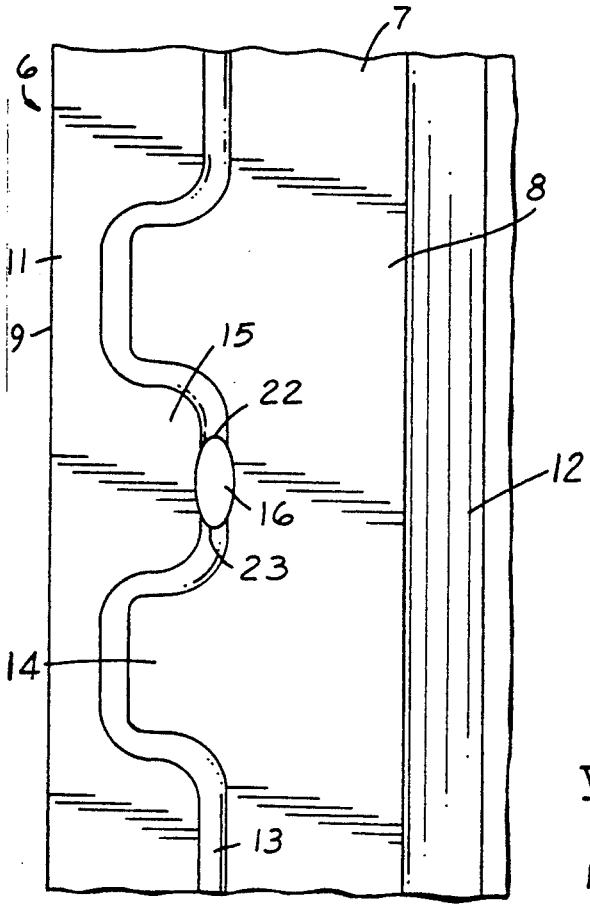
FIG. 5 is a fragmentary top plan view of the heat exchanger plate, showing the opening in the outer side wall of the gasket groove.

Referring now more particularly to the drawings, and especially to FIGS. 1–7 thereof, there is shown a gasket 1 made of flexible, compressible material and having an elongated main body portion 2 provided with integral tabs 3. The tabs 3 are spaced apart longitudinally and project laterally outwardly from the main body portion 2 of the gasket on the side of the main body portion remote from the heat exchange area of the plate to be sealed. The bottoms 4 of the tabs 3 preferably are horizontal and flat and co-planar or flush with the flat horizontal sealing surface 5 on the bottom of the main body portion 2.

A heat exchanger plate 6, preferably of metal or like relatively stiff material, has an elongated groove 7 which extends around the perimeter of the plate and also around any portholes in the plate. The main body portion 2 of the gasket is adapted to lie in the groove 7 with its underside 5 in sealing engagement with the flat horizontal bottom wall 8 of the groove to provide a sealed heat exchange area inside the gasket, that is, on the side of the gasket away from the plate edge 9. The main body portion 2 of the gasket also has a flat sealing surface 10 along the top which abuts and seals against the heat exchanger plate in front of it.

The groove 7 is spaced inwardly from the edge 9 of the plate and is depressed downwardly relative to the marginal plate portion 11 between the groove 7 and the plate edge. The groove 7 has upwardly flaring inner and outer side walls 12 and 13. The outer side wall 13 of the groove nearest to the plate edge is corrugated or scalloped in a serpentine pattern as viewed in FIG. 5 to provide extensions 14 of the groove 7 which extend into the marginal plate portion 11 and the bottoms of which lie in the same plane as the bottom of the groove 7. One of the purposes of scalloping the outer side wall of the groove 7 is to strengthen the plate. The marginal plate portion 11 between extensions 14 provide dimples 15.

Identical openings 16 are formed in the outer side wall of groove 7 at longitudinally spaced apart points adjacent the dimples 15. The openings 16 are preferably somewhat elongated as in FIG. 5. Each opening 16 extends from its laterally outwardly facing, vertical bottom edge 17 at the tangent point of merger of side wall 13 with the bottom of groove 7 to its laterally inwardly facing, vertical top edge 18 at the tangent point of merger of said wall 13 with the marginal plate portion 11. These openings are spaced apart the same distances as the tabs 3 of the gasket in order to receive the tabs when the main body portion 2 of the gasket is placed in the groove 7.

Openings 16 may be produced on a flat sheet blank, prior to forming or pressing of the plate, either by machining or with a piercing die. Openings 16 can also be produced after forming the plate, by either punching or machining. In either case, openings 16 are developed so that they do not go beyond the tangent point at the upper extremity of the outer side wall 13 of the gasket groove 7 nor beyond the tangent point at the lower extremity thereof.

Figure 6:
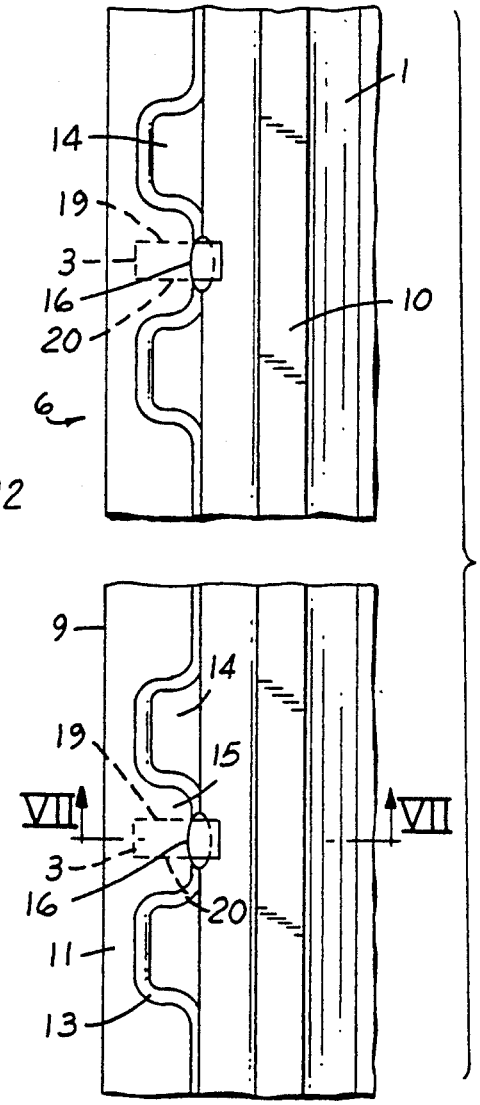
FIG. 6 is a fragmentary top plan view of the heat exchanger plate showing the gasket seated in the groove with tabs extending into openings in the outer side wall of the groove.
Figure 7:
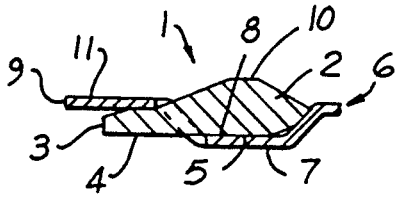
FIG. 7 is a sectional view taken on the line VII—VII in FIG. 6.

Each tab 3 is an elongated member having, in addition to bottom wall 4, opposite side walls 19 and 20 which are preferably in planes at right angles to the longitudinal centerline of the main body portion 2 of the gasket, and a top wall 21 which tapers laterally outwardly toward bottom wall 4. The vertical thickness of the tabs (that is, the distance between the top and bottom walls 21 and 4 thereof) adjacent to the main body portion 2 of the gasket is greater than the height of the openings 16. At the outer ends of the tabs, the vertical thickness thereof is less than the height of openings 16. Tab 3 is inserted into the opening 16 and then pulled out from the bottom of the outside edge of the plate. As shown in FIG. 7, the thickness of the tapered tab 3 at the contact point is slightly greater than the height of the opening. Therefore, it can be said that the tabs 3 have an interference fit and are somewhat compressed at the top edge 18 as well as the bottom edge 17 of the openings. The width of tab 3 may be such that its sides 19 and 20 either may have some clearance in the opening 16 (as shown in FIG. 6) or may have an interference fit at side edges 22 and 23 of the opening.

Each opening 16 is completely open and unobstructed to permit a tab 3 to be inserted therein.

To assemble the gasket 1 with the plate 6, the main body portion 2 is placed in the groove 7 with the tabs 3 registering with the openings 16. Then the tabs are inserted into the openings with a lateral movement either by hand or with a tool. The flexible and compressible nature of the tabs enables them to distort and compress into the openings. The assembly is complete after all tabs are pushed into the openings in this manner. If necessary, the outer ends of the tabs can be grasped and pulled from the underside of the plate to fully install the tabs and fully seat the main body portion 2 of the gasket in groove 7. No other securing means are required to hold the gasket in assembly with the plate.

FIG. 8 shows a gasket 1 with a tab 25 of modified construction. It will be understood that the tab 25 will be one of a plurality of integral tabs (replacing tabs 3 previously described) which are spaced apart longitudinally and project laterally outwardly from the main body portion 2 of the gasket 1 on the side thereof remote from the heat exchange area of the plate to be sealed. Preferably the bottom surface 26 of the tab is in the same plane as the bottom 5 of the main body portion 2 of the gasket. The tab has a top surface 27 which is preferably parallel to the bottom surface 26 and is spaced above the bottom surface by an amount preferably equal to the distance between the top surface of the bottom wall 8 of the groove 7 in plate 6 previously described and the top surface of the marginal plate portion 11 thereof. This relationship is clearly shown in FIG. 9 where the gasket is shown fully seated in the groove of plate 6 with the tab fully installed in one of the openings 16 thereof. When fully seated and installed as in FIG. 9, the gasket and tab are not under any appreciable compression.

The tab has an outwardly extended nose 28, the bottom surface of which is connected to the bottom surface 26 of the tab by a laterally inwardly facing vertical step or shoulder 30. When fully installed as in FIG. 9, the shoulder 30 engages the bottom edge 17 of the opening 16.

The top surface 29 of the nose 28 is preferably parallel to the bottom and top surfaces 26 and 27 of the tab and is connected to the top surface thereof by a laterally outwardly facing vertical step or shoulder 31. When fully installed as in FIG. 9, this shoulder 31 engages the upper edge 18 of the opening and the top surface 29 of the nose is in flush contact with the under surface of the marginal portion 11.

The gasket with the modified tabs of FIGS. 8 and 9 is installed in the plate 6 by first placing the main body portion 2 of the gasket in the groove 7 of the plate with the tabs 25 registering with the openings 16. Then the tabs are inserted into the openings with a lateral movement either by hand or with a tool. The assembly is complete after all of the tabs are pushed into the openings into the positions shown in FIG. 9 in which the shoulder 30 snaps over the lower edge 17 of the opening 16 to resist withdrawal of the tab and the shoulder 31 comes into contact with the upper edge 18 of the opening to locate the fully inserted position of the tab. The width of the tabs is preferably less than the width of the openings 16 between the side edges 22 and 23 thereof.

FIG. 10 shows the gasket 1 with an integral tab 25', like tab 25 shown in FIGS. 8 and 9, but modified to the extent that it has an integral triangular pilot or extension 32 provided with sides 33 and 34 which taper towards one another in outward direction beyond the outer end of the nose 28. This triangular extension is generally horizontal and is located just beneath the shoulder 31, having laterally spaced corners 35 and 36 disposed laterally outwardly beyond the sides of the tab. These corners are spaced apart a distance greater than the distance between the side edges 22 and 23 of the opening 16 in plate 6 so as to have a snap-in engagement in the opening when fully installed. In other words, when the tab 25' is fully installed in the opening with shoulder 30 snapped over the lower edge 17 of the opening and shoulder 31 abutting the upper edge 18 of the opening, the corners of the extension will have snapped through the sides of the opening to retain the snapped-in connection.

FIG. 11 shows the gasket 1 with an integral tab 25'', generally like the tab 25 in FIGS. 8 and 9 but having an extended nose 28' to make it easier to be grasped from the underside of the plate to pull the tab into a fully installed position with respect to an opening 16. The tabs 25 and 25' are somewhat elongated and capable of being grasped by the nose 28 from the underside for pulling the tabs through the openings, but the extended nose 28' of the modification of FIG. 11 makes this procedure easier to perform.

FIG. 12 shows the gasket 1 having an integral tab of a still further modified construction. The tab in FIG. 12 is designated 40 and is an elongated, generally cylindrical body which may be circular in cross-section or somewhat oval shaped, matching the generally overall shape of the openings 16 in the plate 6. The tab 40 extends laterally outwardly in a horizontal direction with its bottom surface generally flush with the bottom surface 5 of the main body portion 2 of the gasket. The outer extremity of the tab is a blunt, generally vertical surface 41 on which there is an integral button-like extension 42, likewise having a generally vertically disposed outer surface 43. Preferably these outer surfaces 41 and 43, although generally vertical, taper somewhat as shown in FIG. 13 so as to be inclined outwardly and upwardly. The button 42 is of a size and shape generally corresponding to that of the openings 16 in the plate 6 or somewhat smaller. The button is smaller than the tab, being substantially flush with the bottom surface of the tab but spaced from the top surface thereof. The incline on the outer surface of the button 42 enables it to snap into the opening when the main body portion 2 of the gasket is placed in the groove 7 and downward pressure is applied against the tab 40. In other words, no appreciable lateral movement of the gasket is necessary to install the tab including its button in the opening. Of course, the main body portion of the tab 40 fits within the opening at least partially as shown in FIG. 13, but only the top edge of the button fits under the top edge of the opening. In the installed position of the tab, the vertical surface 41 above the button contacts the upper edge of the opening.

Figure 14:
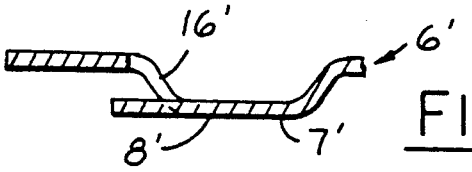
FIG. 14 is a sectional view similar to FIG. 4 showing a plate of modified construction for receiving the gasket tabs shown in FIGS. 1 and 12.

FIG. 14 shows a modified plate 6' in cross-section in which the openings 16' are formed, not by metal removal, but by merely cutting out the metal along three sides where the opening is to be formed, namely the top and two side edges of the opening, and then displacing the cut out metal into a horizontal plane forming a continuation of the bottom wall 8' of the groove 7'. The gasket tabs shown in FIGS. 1 and 12 may be readily installed in the openings of a plate constructed in accordance with the modification shown in FIG. 14.

Figure 15:
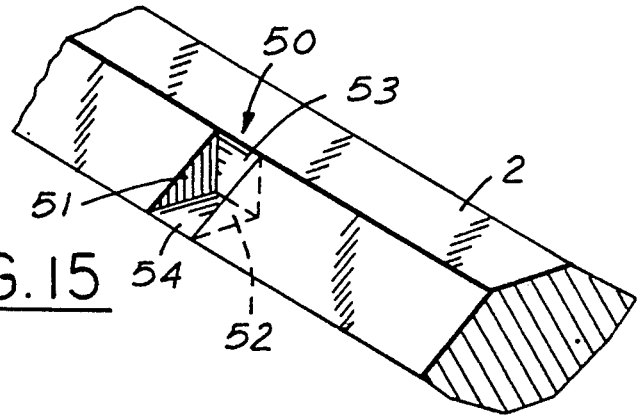
FIG. 15 is an isometric view of a portion of a gasket constructed in accordance with yet another embodiment of this invention.
Figure 16:
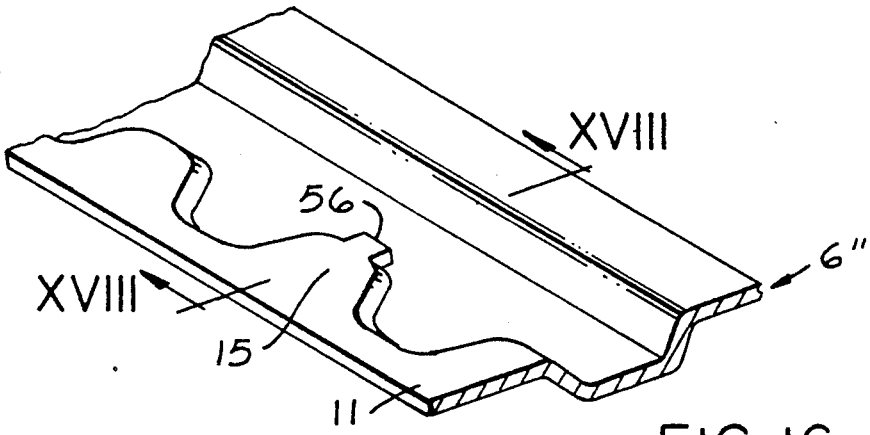
FIG. 16 is an isometric view of a portion of a modified plate constructed to receive the gasket shown in FIG. 15, as seen from one side of the plate.

FIG. 15 is a view of a gasket in which, instead of tabs, recesses 50 are provided in the main body portion 2 at longitudinally spaced points. Each recess has a pair of longitudinally spaced side walls 51 and 52 which are at right angles to the longitudinal centerline of the main body portion 2, a vertical rear wall 53 parallel to such longitudinal centerline, and a horizontal bottom wall 54. The plate 6'' is generally like the plate 6 previously described, except that the openings 16'' are formed not by cutting out metal in the side wall of the groove but by cutting such metal along three sides and then bending it up into the plane of the marginal plate portion 11 to provide a generally rectangular tab 56. The opening 16'' is otherwise like the opening 16 of plate 6. These openings 16'' and tabs 56 are spaced apart the same distances as the recesses 50 in the gasket and are formed in the portions of the side wall of the groove adjacent to the dimples 15.

Figure 18:
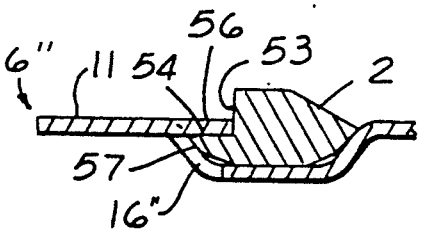
FIG. 18 is a sectional view taken on the line XVIII—XVIII in FIG. 16.
Figure 17:
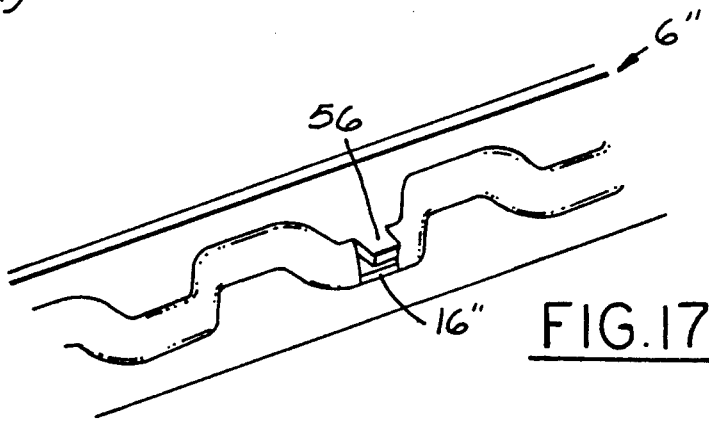
FIG. 17 is an isometric view of a portion of the heat exchanger plate shown in FIG. 16, as seen from the opposite side thereof.

FIG. 18 shows the installed position of the gasket in which the tabs 56 extend into the gasket recesses 50 and engage the bottom walls 54 of the recesses. This gasket is installed in the plate groove with a downward and slight lateral movement to arrive at the fully seated position shown in FIG. 18. The inclined underside 57 of the main body portion 2 of the gasket cams past the tab during assembly of the gasket in the groove. The main body portion 2 of the gasket extends under the tabs 56 but does not actually enter the openings 16''.

Some of the gaskets here shown can be described as snap-in gaskets. Thus the gaskets in FIGS. 8–13, 15 and 18 may be considered snap-in gaskets. All of the gaskets shown herein are glueless gaskets.

A plurality of heat exchanger plates with glueless or snap-in gaskets of the construction shown herein may be clamped between stationary and movable frames to form a plate and frame heat exchanger. Likewise, a plate and frame heat exchanger can be formed by intermixing plates with gaskets having any combination of the glueless and/or snap-in constructions shown. Also, a plate and frame heat exchanger can be formed by intermixing plates with gaskets having any one of the connections shown herein with plates having glued gaskets.

What is claimed is:

1. In combination, a heat exchanger plate having an elongated groove spaced inwardly from an edge of said plate and depressed downwardly relative to a marginal plate portion between said groove and said plate edge, said groove having a bottom wall and laterally spaced inner and outer side walls, a plurality of openings in said outer side wall, said openings being located entirely in said outer side wall and spaced apart longitudinally of said groove, a gasket of flexible, compressible material having an elongated main body portion seated in said groove, said gasket having tabs integral with said main body portion projecting into and through said openings, said tabs being elongated and projecting sufficiently beyond said openings so that they may be grasped by hand or by a tool from the side of said plate opposite the side in which said groove is formed and pulled completely through said openings to fully seat said main body portion of said gasket in said groove.

2. In combination, a heat exchanger plate having an elongated groove spaced inwardly from an edge of said plate and depressed downwardly relative to a marginal plate portion between said groove and said plate edge, said groove having a bottom wall and laterally spaced inner and outer side walls, a plurality of openings in said outer side wall, said openings being spaced apart longitudinally of said groove, a gasket of flexible, compressible material having an elongated main body portion seated in said groove, said gasket having tabs integral with said main body portion projecting into and through said openings, said tabs being elongated and projecting sufficiently beyond said openings so that they may be grasped by hand or by a tool from the side of said plate opposite the side in which said groove is formed and pulled through said openings to fully seat said main body portion of said gasket in said groove, said tabs tapering laterally outwardly and have a wedging interference with opposite edges of said openings.

3. The combination defined in claim 2, wherein said side walls of said grooves flare upwardly and outwardly from said bottom wall thereof, said openings have upper edges at approximately the tangent point of merger of said outer side wall with said marginal plate portion and have lower edges at approximately the tangent point of merger of said outer side wall with said bottom wall of said groove, said tabs each having a top surface and a bottom surface which are inclined toward one another in an outward direction to produce said taper, said interference occurring between said upper and lower edges of said openings and said top and bottom surfaces of said tabs.

4. In combination, a heat exchanger plate having an elongated groove spaced inwardly from an edge of said plate and depressed downwardly relative to a marginal plate portion between said groove and said plate edge, said groove having a horizontal bottom wall and laterally spaced inner and outer side walls, a plurality of openings in said outer side wall, said openings being spaced apart longitudinally of said groove, a gasket of flexible, compressible material having an elongated main body portion seated in said groove, said gasket having tabs integral with said main body portion projecting into and through said openings, said tabs tapering laterally outwardly and having a wedging interference with opposite edges of said openings.

5. The combination defined in claim 4, wherein said side walls of said grooves flare upwardly and outwardly from said bottom wall thereof, said openings have upper edges at approximately the tangent point of merger of said outer side wall with said marginal plate portion and have lower edges at approximately the tangent point of merger of said outer side wall with said bottom wall of said groove, said tabs each having a top surface and a bottom surface which are inclined toward one another in an outward direction to produce said taper, said interference occurring between said upper and lower edges of said openings and said top and bottom surfaces of said tabs.

6. The combination defined in claim 5, wherein said main body portion of said gasket has a bottom surface which rests on the bottom wall of said groove, and said bottom surface of each tab is flat and horizontal and generally co-planar with said bottom surface of said main body portion.

7. In combination, a heat exchanger plate having an elongated groove spaced inwardly from an edge of said plate and depressed downwardly relative to a marginal plate portion between said groove and said plate edge, said groove having a bottom wall and laterally spaced inner and outer side walls, said side walls flaring upwardly and outwardly from said bottom wall, a plurality of openings in said outer side wall, said openings being spaced apart longitudinally of said groove, said openings having upper edges at approximately the tangent point of merger of said outer side wall with said marginal plate portion and having lower edges at approximately the tangent point of merger of said outer side wall with said bottom wall of said groove, a gasket of flexible, compressible material having an elongated main body portion seated in said groove, said gasket having tabs integral with said main body portion projecting into and through said openings, said tabs having top and bottom surfaces and having shoulders on said bottom surfaces thereof snapped over said lower edges of said openings to retain said tabs in said openings.

8. The combination defined in claim 7, wherein said tabs have second shoulders on said top surfaces thereof in substantially abutting relation with said upper edges of said openings when said first-mentioned shoulders snap over said lower edges of said openings as aforesaid.

9. The combination defined in claim 7, wherein each tab has an integral laterally outwardly extending pilot portion provided with sides which taper outwardly from corners which are spaced apart a distance greater than the width of said openings, said corners having a snap-in engagement with said openings when said tabs are fully installed in said openings.

10. The combination defined in claim 9, wherein said pilot portion of each tab is generally triangular.

11. The combination defined in claim 10, wherein said tabs have second shoulders on said top surfaces thereof in substantially abutting relation with said upper edges of said openings when said first-mentioned shoulders snap over said lower edges of said openings as aforesaid.

12. The combination defined in claim 8, wherein each said tab has an extended nose on the outer end extending sufficiently beyond said opening into which said tab projects so that said nose may be grasped from the underside of said plate and said tab pulled through said opening to fully seat said main body portion of said gasket in said groove.

13. In combination, a heat exchanger plate having an elongated groove spaced inwardly from an edge of said plate and depressed downwardly relative to a marginal plate portion between said groove and said plate edge, said groove having a bottom wall and laterally spaced upwardly and outwardly flaring inner and outer side walls, a plurality of openings in said outer side wall, said openings being spaced apart longitudinally of said groove, a gasket of flexible, compressible material having an elongated main body portion seated in said groove, said gasket having tabs integral with said main body portion projecting at least partially into said openings, said tabs each having a button on the outer end engaged under the upper edge of an opening.

14. The combination defined in claim 13, wherein said buttons have a snap-in engagement under said upper edges of said openings when said tabs are pressed downwardly into said openings.

15. The combination defined in claim 14, wherein said buttons are of a size and shape generally similar to that of said openings.

16. The combination defined in claim 15, wherein said end of each tab has a portion above said button which engages said upper edge of said opening.

17. In combination, a heat exchanger plate having an elongated groove spaced inwardly from an edge of said plate and depressed downwardly relative to a marginal plate portion between said groove and said plate edge, said groove having a bottom wall and laterally spaced inner and outer side walls, a plurality of tabs on said outer side wall, said tabs being spaced apart longitudinally of said groove, a gasket of flexible, compressible material having an elongated main body portion seated in said groove, said gasket having recesses in said main body portion receiving said tabs.

18. The combination defined in claim 17, wherein said tabs are formed by material cut from said outer side wall and bent upwardly to a position directed toward said inner side wall.

19. The combination defined in claim 18, wherein said recesses are formed in the upper portion of said main body portion along the outer edge thereof, and the surface of said main body portion beneath said recesses is inclined upwardly and outwardly to cam past said tabs with a snap-in engagement when said main body portion is pressed downwardly into said groove.

20. The combination defined in claim 1, wherein said openings have upper edges at approximately the tangent point of merger of said outer side wall with said marginal plate portion and have lower edges at approximately the tangent point of merger of said outer side wall with said bottom wall of said groove.

* * * * *